US011814275B2

(12) United States Patent
Yi

(10) Patent No.: US 11,814,275 B2
(45) Date of Patent: Nov. 14, 2023

(54) FORKLIFT TRUCK

(71) Applicant: DOOSAN CORPORATION, Seoul (KR)

(72) Inventor: Junil Yi, Seoul (KR)

(73) Assignee: DOOSAN CORPORATION, Seoul (JP)

( * ) Notice: Subject to any disclaimer, the term of this patent is extended or adjusted under 35 U.S.C. 154(b) by 222 days.

(21) Appl. No.: 17/333,702

(22) Filed: May 28, 2021

(65) Prior Publication Data

US 2021/0395062 A1 Dec. 23, 2021

(30) Foreign Application Priority Data

Jun. 19, 2020 (KR) ..... 10-2020-0074678

(51) Int. Cl.
*B66F 9/22* (2006.01)
*F15B 15/14* (2006.01)
*F15B 15/20* (2006.01)

(52) U.S. Cl.
CPC ..... *B66F 9/22* (2013.01); *F15B 15/1409* (2013.01); *F15B 15/20* (2013.01)

(58) Field of Classification Search
CPC ..... B66C 23/705; B66F 9/22; F15B 11/20; F15B 11/22
See application file for complete search history.

(56) References Cited

U.S. PATENT DOCUMENTS 3,481,489 A * 12/1969 Stauffer ..... B66C 13/18 212/231
3,657,969 A * 4/1972 Wirkus ..... F15B 11/20 92/152
3,760,688 A * 9/1973 Dummer ..... B66C 23/705 91/532

(Continued)

FOREIGN PATENT DOCUMENTS

CN 102094870 A * 6/2011 ..... B66C 23/80
DE 19603400 A1 * 8/1997 ..... A01B 63/32
EP 3409638 A1 12/2018

(Continued)

OTHER PUBLICATIONS

CN102094870A_t machine translation into English (Year: 2011).*

(Continued)

*Primary Examiner* — Kenneth Bomberg
*Assistant Examiner* — Matthew Wiblin
(74) *Attorney, Agent, or Firm* — Volpe Koenig

(57) ABSTRACT

A forklift truck includes a carriage that moves up and down by a mast assembly in a multi-stage structure including an outer mast, a first inner mast accommodated in the outer mast, and a second inner mast accommodated in the first inner mast. The forklift truck includes a first lift cylinder configured to move the first inner mast up and down; a second lift cylinder configured to move the second inner mast up and down and having a pressure reception area less than a pressure reception area of the first lift cylinder. A first lift hydraulic line supplies hydraulic oil to the first lift (Continued)

cylinder. A second lift hydraulic line supplies hydraulic oil to the second lift cylinder. A pressure regulating valve is provided to increase a pressure of the hydraulic oil to a pressure capable of driving the second lift cylinder.

3 Claims, 2 Drawing Sheets

(56) References Cited

U.S. PATENT DOCUMENTS

| | | | | |
|---|---|---|---|---|
| 2011/0091306 | A1* | 4/2011 | Roux | B66F 9/08 414/667 |
| 2019/0084816 | A1* | 3/2019 | Stolten | B66F 9/22 |

FOREIGN PATENT DOCUMENTS

| | | | |
|---|---|---|---|
| JP | S52-56870 | U | 4/1977 |
| JP | S52-59375 | U | 4/1977 |
| JP | 04-88497 | U | 7/1992 |
| JP | 08-143292 | A | 6/1996 |
| JP | 11-228094 | A | 8/1999 |
| KR | 10-2008-0040861 | A | 5/2008 |
| KR | 20120070304 | A | 6/2012 |

OTHER PUBLICATIONS

Office Action issued in corresponding Korean Patent Application No. 10-2020-0074678 dated Jul. 6, 2021.
Search Report issued in corresponding European Patent Application No. 21159281.1 dated Aug. 3, 2021.

* cited by examiner

FORKLIFT TRUCK

CROSS-REFERENCE TO RELATED APPLICATION

This application claims priority to and the benefit of Korean Patent Application No. 10-2020-0074678, filed on Jun. 19, 2020, in the Korean Intellectual Property Office (KIPO), the disclosure of which is incorporated by reference herein in its entirety.

1. TECHNICAL FIELD

Aspects of embodiments relate to a forklift truck, and more particularly, to a forklift truck provided with a multi-stage mast assembly.

2. DISCUSSION OF RELATED ART

In general, forklift trucks are used to lift and lower heavy loads and to transport them to a desired location. Such a forklift truck has a vehicle body, and a mast assembly is installed in the front of the vehicle body.

For example, the mast assembly may include an outer mast and multi-stage inner masts that are installed to overlap an inner side of the outer mast. A mast assembly having such a multi-stage structure is disclosed in Korean Patent Publication No. 10-2012-0070304. A carriage is coupled to the inner mast so that it may move up and down. The carriage and the inner mast may move up and down by a first lift cylinder and a second lift cylinder. In addition, a pair of forks are installed at the carriage of the mast assembly. The pair of forks serve to lift a load in a direct manner and are installed with adjustable spacing. Further, instead of the fork, other attachments, for example, a hinged bucket, a side shift, a load stabilizer, a rotating fork, etc. may be mounted. In such a case, the attachment may be installed so that it may receive a hydraulic oil through an attachment line.

In the forklift truck as described above, when the first lift cylinder and the second lift cylinder are operated in a state that a load is supported by the pair of forks, the carriage and the pair of forks installed in the carriage are lifted upward. Accordingly, it is possible to lift the load supported by the forks to a desired position.

Particularly, in a case where the forklift truck lifts the fork to lift a load to a higher position, the mast may be formed in a multi-stage structure. That is, as a maximum fork height is higher, the mast of the forklift truck is formed as a multi-stage structure. When a mast of three or more stages is used, two or more lift cylinders may be used.

As described above, in a case where two or more lift cylinders are used, if a pressure reception area) of the first lift cylinder is relatively wide, the first lift cylinder is first stretched at a low hydraulic oil pressure, and after the first lift cylinder is stretched to a maximum, a second lift cylinder having a relatively small pressure reception area moves. That is, the first lift cylinder and the second lift cylinder operate sequentially due to a difference in the pressure reception area.

In such a case, however, when the first lift cylinder and the second lift cylinder operate sequentially due to a difference in the pressure reception area, there is a problem in that an impact occurs and a speed difference is generated in a process of switching from the first lift cylinder to the second lift cylinder.

If the first lift cylinder and the second lift cylinder are formed to have the same pressure reception area in order to eliminate the occurrence of such an impact, either of the two lift cylinders may operate earlier than the other without consistency, depending on the pressure or flow rate of the hydraulic oil, and thus it is difficult to stably control the forklift truck.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Embodiments of the present disclosure may be directed to a forklift truck capable of operating a plurality of lift cylinders together for operating a multi-stage mast assembly, thereby suppressing occurrence of an impact that may occur due to operation switching between a plurality of lift cylinders.

According to an embodiment, a forklift truck, in which a carriage moves up and down by a mast assembly in a multi-stage structure including an outer mast, a first inner mast accommodated in the outer mast and moving up and down, and a second inner mast accommodated in the first inner mast and moving up and down, includes a first lift cylinder configured to move the first inner mast up and down; a second lift cylinder configured to move the second inner mast up and down and having a pressure reception area less than a pressure reception area of the first lift cylinder; a first lift hydraulic line configured to supply a hydraulic oil to the first lift cylinder; a second lift hydraulic line connected to the first lift hydraulic line and configured to supply a hydraulic oil to the second lift cylinder; and a pressure regulating valve installed on the first lift hydraulic line and configured to increase a pressure of the hydraulic oil to a pressure capable of driving the second lift cylinder.

In some embodiments, the forklift truck may further include a main control valve configured to control supply of the hydraulic oil to the first lift cylinder and the second lift cylinder; a main hydraulic pump configured to supply the hydraulic oil to the main control valve; and a main lift hydraulic line of which one end is connected to the main control valve and another end is connected to the first lift hydraulic line and the second lift hydraulic line.

In some embodiments, the pressure regulating valve may be an electric proportional pressure reducing (EPPR) valve. When the pressure regulating valve adjusts a pressure of the first lift hydraulic line, a pressure of the second lift hydraulic line may also be adjusted.

In some embodiments, the pressure regulating valve may adjust an opening rate by using a pilot pressure and an elastic member and adjust a pressure increase amount by adjusting an elastic modulus of the elastic member.

In some embodiments, a front-end pressure of the pressure regulating valve, a pressure of the hydraulic oil supplied to the first lift cylinder, and a pressure of the hydraulic oil supplied to the second lift cylinder may be received as the pilot pressure, and an opening area may be proportionally controlled based on the pilot pressure.

In some embodiments, the pressure supplied to the second lift cylinder may act in the same direction as an elastic force of the elastic member, and the front-end pressure of the pressure regulating valve and the pressure of the hydraulic oil supplied to the first lift cylinder may act in a direction opposite to the elastic force of the elastic member.

In some embodiments, the forklift truck may further include a first pressure sensor configured to measure a front-end pressure of the pressure regulating valve; a second pressure sensor configured to measure a pressure of the first lift hydraulic line, between the pressure regulating valve and the first lift cylinder; a third pressure sensor configured to measure a pressure of the second lift hydraulic line; and a controller configured to control the pressure regulating valve based on information received from the first pressure sensor, the second pressure sensor, and the third pressure sensor.

In some embodiments, the controller may calculate a flow rate ratio of the hydraulic oil supplied to the first lift cylinder and the hydraulic oil supplied to the second lift cylinder, based on information on a pressure difference between the pressure measured by the first pressure sensor and the pressure measured by the second pressure sensor and a pressure difference between the pressure measured by the first pressure sensor and the pressure measured by the third pressure sensor, and control operation speeds of the first lift cylinder and the second lift cylinder by controlling the pressure regulating valve based on the calculated flow rate ratio.

The foregoing is illustrative only and is not intended to be in any way limiting. In addition to the illustrative aspects, embodiments and features described above, in addition aspects, embodiments and features will become apparent by reference to the drawings and the following detailed description.

BRIEF DESCRIPTION OF THE DRAWINGS

A more complete appreciation of the present disclosure will become more apparent by describing in detail embodiments thereof with reference to the accompanying drawings, wherein.

DETAILED DESCRIPTION

Figure 1:
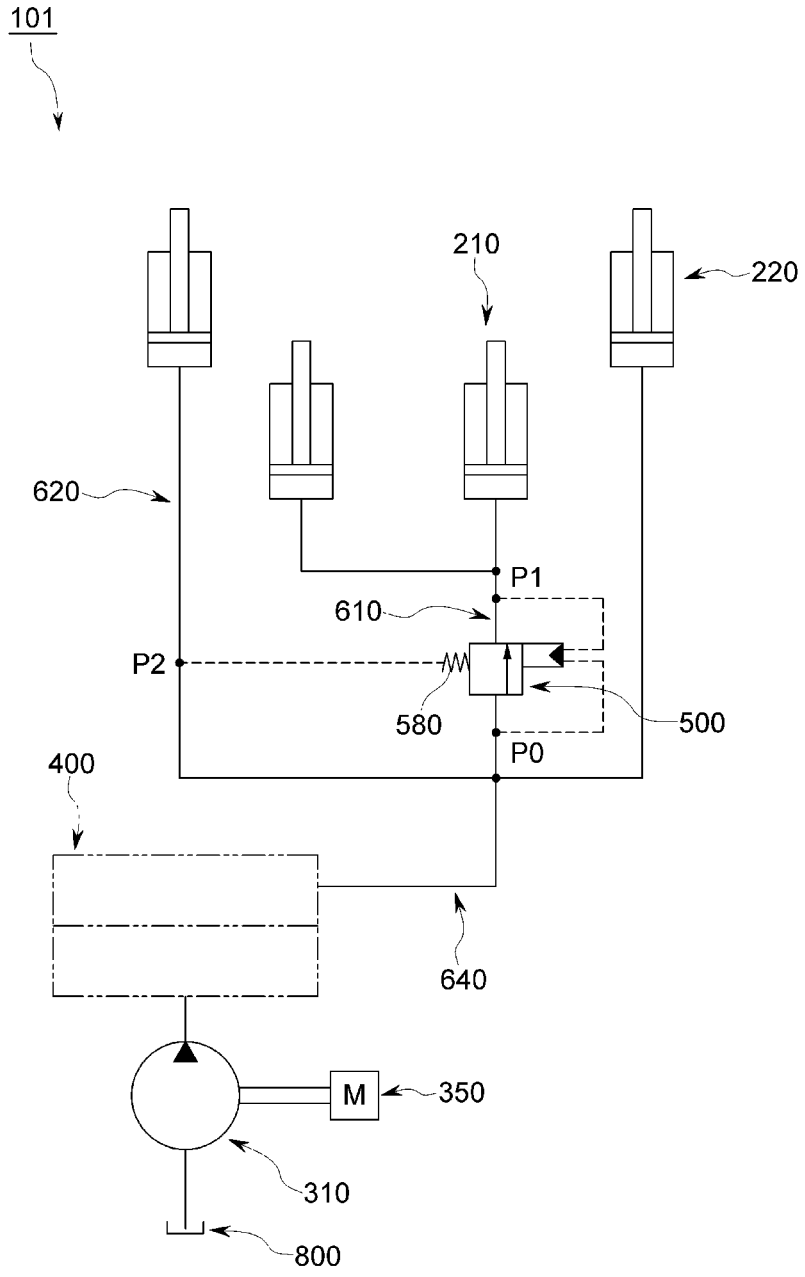
FIG. 1 illustrates a hydraulic system for operating a lift cylinder of a forklift truck according to a first embodiment of the present disclosure.

Hereinafter, embodiments of the present disclosure will be described in detail with reference to the accompanying drawings so that those skilled in the art to which the present disclosure pertains may readily understand and practice the inventive concept. The present disclosure may be implemented in many different forms and is not limited to the embodiments described herein.

In addition, in various embodiments, components having the same configuration are typically described in a first embodiment by using the same reference numerals, and in other embodiments, for example, in a second embodiment, only the configuration different from the first embodiment will be described.

It is to be understood that the drawings are schematic and not to scale. The relative dimensions and proportions of the parts in the drawings are illustrated exaggerated or reduced in size for clarity and convenience, and any dimensions are merely illustrative and not limiting. Like reference numerals are used to indicate similar features in the same structures, elements, or parts appearing in two or more drawings.

Embodiments of the present disclosure specifically represent representative embodiments of the present disclosure. Accordingly, various modifications based on the illustration are expected. Accordingly, embodiments are not limited to a specific form of the illustrated area, and includes, for example, modification of the form by manufacturing.

Hereinafter, a forklift truck 101 according to a first embodiment of the present disclosure will be described with reference to FIG. 1. For example, in the forklift truck 101, a carriage may move up and down by a mast assembly in a multi-stage structure which includes an outer mast, a first inner mast accommodated in the outer mast and moving up and down, and a second inner mast accommodated in the first inner mast and moving up and down.

As illustrated in FIG. 1, the forklift truck 101 according to the first embodiment of the present disclosure includes a first lift cylinder 210, a second lift cylinder 220, a first lift hydraulic line 610, a second lift hydraulic line 620, and a pressure regulating valve 500.

In addition, the forklift truck 101 according to the first embodiment of the present disclosure may further include a main control valve (MCV) 400, a main hydraulic pump 310, a main lift hydraulic line 640, a power unit 350, and a hydraulic oil tank 800.

The first lift cylinder 210 is operated by a pressure of a hydraulic oil discharged by the main hydraulic pump 310, to be described below, to move the first inner mast up and down.

The second lift cylinder 220 is operated by a pressure of the hydraulic oil discharged by the main hydraulic pump 310, to be described below, to move the second inner mast up and down. In an embodiment, the second lift cylinder 220 has a pressure reception area less than a pressure reception area of the first lift cylinder 210. That is, the second lift cylinder 220 is operated when a hydraulic oil having a pressure higher than that of the first lift cylinder 210 is supplied.

The first lift hydraulic line 610 supplies the hydraulic oil to the first lift cylinder 210.

The second lift hydraulic line 620 supplies the hydraulic oil to the second lift cylinder 220 and is connected to the first lift hydraulic line 610.

The MCV 400 may control the supply of the hydraulic oil to the first lift cylinder 210 and the second lift cylinder 220. Specifically, the MCV 400 may distribute the hydraulic oil discharged by the main hydraulic pump 310, to be described below, to supply the distributed hydraulic oil to the first lift cylinder 210 and the second lift cylinder 220, respectively.

The main hydraulic pump 310 may supply a hydraulic oil to the MCV 400. That is, the main hydraulic pump 310 may discharge a hydraulic oil stored in the hydraulic oil tank 800 to be described below. In addition, the MCV 400 supplies the hydraulic oil discharged from the main hydraulic pump 310 to the first lift cylinder 210 and the second lift cylinder 220.

The power unit 350 is connected to the main hydraulic pump 310 to provide a power. Various types of engines or electric motors that generate power by burning fuel may be used as the power unit 350. For example, the type of engine used as the power unit 350 may include: diesel engines, liquefied natural gas (LNG) engines, compressed natural gas (CNG) engines, adsorbed natural gas (ANG) engines, liquefied petroleum gas (LPG) engines, or gasoline engines.

The hydraulic oil tank 800 may store the hydraulic oil to be supplied to the first lift cylinder 210 and the second lift cylinder 220.

The main lift hydraulic line 640 may have one end connected to the MCV 400 and another end connected to the first lift hydraulic line 610 and the second lift hydraulic line 620. That is, the hydraulic oil supplied from the MCV 400 moves along the main lift hydraulic line 640 and then branches into the first lift hydraulic line 610 and the second lift hydraulic line 620. Accordingly, the hydraulic oil supplied through the first lift hydraulic line 610 and the hydraulic oil supplied through the second lift hydraulic line 620 have substantially the same pressure, ultimately.

The pressure regulating valve 500 is installed on the first lift hydraulic line 610 to increase the pressure of the hydraulic oil to a pressure capable of driving the second lift cylinder 220.

Specifically, the pressure regulating valve 500 may be an electric proportional pressure reducing (EPPR) valve. That is, the pressure regulating valve 500, which adjusts an opening rate by using a pilot pressure and an elastic member 580, may adjust an elastic modulus of the elastic member 580 to adjust a pressure increase amount. For example, as the elastic modulus of the elastic member 580 increases, a higher pressure is required to increase the opening rate of the pressure regulating valve 500. Accordingly, the pressure of the hydraulic oil is further increased.

As such, the pressure regulating valve 500 may receive, as the pilot pressures, a front-end pressure P0 of the pressure regulating valve 500, a pressure P1 of the hydraulic oil supplied to the first lift cylinder 210, and a pressure P2 of the hydraulic oil supplied to the second lift cylinder 220 and may proportionally control an opening area based on the pilot pressures, thereby enabling pilot hydraulic control without a separate controller. Herein, the pressure P2 supplied to the second lift cylinder 220 acts in the same direction as an elastic force of the elastic member 580, and the front-end pressure P0 of the pressure regulating valve 500 and the pressure P1 of the hydraulic oil supplied to the first lift cylinder 210 may act in a direction opposite to the elastic force of the elastic member 580.

In the first embodiment of the present disclosure, since the pressure reception area of the second lift cylinder 220 is less than the pressure reception area of the first lift cylinder 210, the pressure capable of operating the second lift cylinder 220 is higher than the pressure capable of operating the first lift cylinder 210.

Accordingly, in a case where the pressure regulating valve 500 as described above is not installed, when the hydraulic oil supplied from the MCV 400 is provided to the first lift cylinder 210 and the second lift cylinder 220 simultaneously, a supply pressure of the hydraulic oil increases. As the supply pressure of the hydraulic oil increases, the first lift cylinder 210 first starts operating at a point in time when the supply pressure becomes equal to a pressure capable of operating the first lift cylinder 210. Then, after the first lift cylinder 210 is stretched to the maximum, when the supply pressure rises to reach the pressure capable of operating the second lift cylinder 220, the second lift cylinder 220 starts operating.

That is, when the hydraulic oil is supplied to the first lift cylinder 210 and the second lift cylinder 220 in a state that the aforementioned pressure regulating valve 500 is not installed, the first lift cylinder 210 and the second lift cylinder 220 are operated sequentially due to a difference in the pressure reception areas of the first lift cylinder 210 and the second lift cylinder 220. In such a case, in a process of switching from the first lift cylinder 210 to the second lift cylinder 220, an impact may occur and a speed difference is generated.

However, in the first embodiment of the present disclosure, the pressure regulating valve 500 increases the pressure of the hydraulic oil, thereby operating the first lift cylinder 210 and the second lift cylinder 220 together.

For example, the pressure regulating valve 550 may increase the pressure by a pressure difference ($\Delta P$) obtained by subtracting the pressure of the hydraulic oil capable of operating the first lift cylinder 210 from the pressure of the hydraulic oil capable of operating the second lift cylinder 220. In such a case, this pressure difference ($\Delta P$) may be generated by proportionally controlling the opening area based on the pilot pressures of each of the elastic force of the elastic member 580 of the pressure regulating valve 500, the front-end pressure P0 of the pressure regulating valve 500, the pressure P1 of the hydraulic oil supplied to the first lift cylinder 210 and the pressure P2 of the hydraulic oil supplied to the second lift cylinder 220.

Accordingly, when the pressure regulating valve 500 adjusts and increases the pressure of the first lift hydraulic line 610, the pressure of the second lift hydraulic line 620 is also adjusted to increase. Accordingly, the pressure of the second lift hydraulic line 620 is increased to the pressure capable of driving the second lift cylinder 220, such that the second lift cylinder 220 is operated together with the first lift cylinder 210.

Since the pressure reception areas of the first lift cylinder 210 and the second lift cylinder 220, however, are different from each other, the lifting speeds of the first lift cylinder 210 and the second lift cylinder 220 may be different from each other.

However, since the first lift cylinder 210 and the second lift cylinder 220 operate together, the impact and the speed difference that may occur when the first lift cylinder 210 operates before the second lift cylinder 220 operates in a sequential manner may be resolved.

With such a configuration, the forklift truck 101 according to the first embodiment of the present disclosure may operate the plurality of lift cylinders for operating the multi-stage mast assembly together, thereby effectively suppressing the occurrence of impacts that may occur due to operation switching.

In addition, the forklift truck 101 may also suppress unintended speed changes during the lifting operation of the carrier.

Hereinafter, a forklift truck 102 according to a second embodiment of the present disclosure will be described with reference to FIG. 2.

Figure 2:
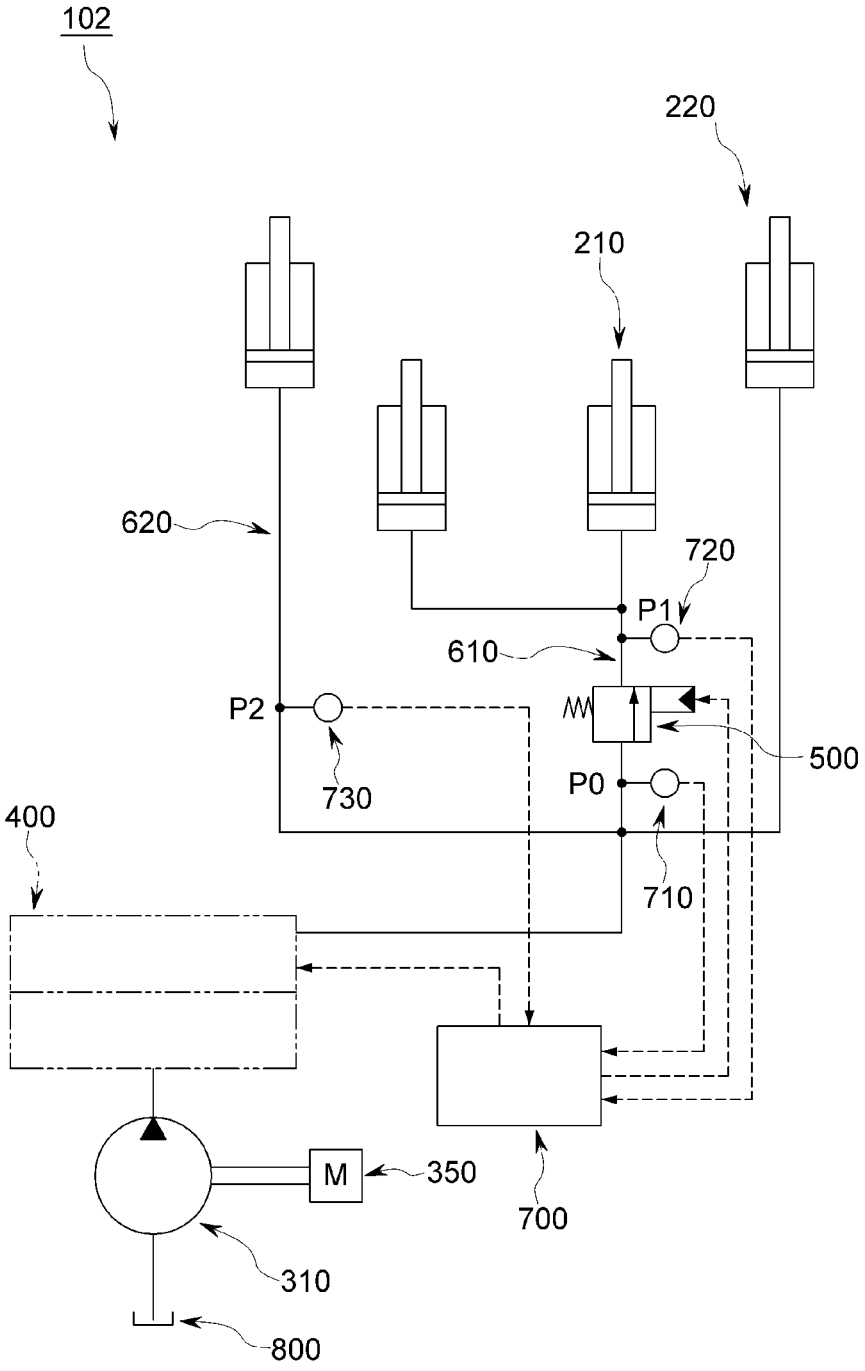
FIG. 2 illustrates a hydraulic system for operating a lift cylinder of a forklift truck according to a second embodiment of the present disclosure.

As illustrated in FIG. 2, the forklift truck 102 according to the second embodiment of the present disclosure includes a first lift cylinder 210, a second lift cylinder 220, a first lift hydraulic line 610, a second lift hydraulic line 620, a pressure regulating valve 500, a first pressure sensor 710, a second pressure sensor 720, a third pressure sensor 730, and a controller 700.

In addition, the forklift truck 102 according to the second embodiment of the present disclosure may further include an MCV 400, a main hydraulic pump 310, a main lift hydraulic line 640, a power unit 350, and a hydraulic oil tank 800.

As such, the forklift truck 102 according to the second embodiment of the present disclosure, as compared to the first embodiment, may further include the first pressure sensor 710, the second pressure sensor 720, the third pressure sensor 730, and the controller 700.

In addition, in the second embodiment of the present disclosure, the pressure regulating valve 500 may be an electric proportional pressure reducing (EPPR) valve, and an opening rate may be adjusted according to a pilot signal transmitted from the controller 700 to be described below.

The first pressure sensor 710 measures a front-end pressure of the pressure regulating valve 500. In such an embodiment, the front-end pressure of the pressure regulating valve 500 may mean a pressure of a hydraulic oil flowing into the pressure regulating valve 500.

The second pressure sensor 720 may measure a pressure of the first lift hydraulic line 610 between the pressure regulating valve 500 and the first lift cylinder 210. That is, the second pressure sensor 720 measures a pressure of the hydraulic oil supplied to the first lift cylinder 210.

The third pressure sensor 730 measures a pressure of the second lift hydraulic line 620. That is, the third pressure sensor 730 measures a pressure of the hydraulic oil supplied to the second lift cylinder 220.

The controller 700 controls the pressure regulating valve 500 based on information received from the first pressure sensor 710, the second pressure sensor 720, and the third pressure sensor 730.

Specifically, the controller 700 may calculate a flow rate ratio of the hydraulic oil supplied to the first lift cylinder 210 and the hydraulic oil supplied to the second lift cylinder 220 based on information on a pressure difference between the pressure measured by the first pressure sensor 710 and the pressure measured by the second pressure sensor 720 and a pressure difference between the pressure measured by the first pressure sensor 710 and the pressure measured by the third pressure sensor 730, and may control operation speeds of the first lift cylinder 210 and the second lift cylinder 220 by controlling the pressure regulating valve 500 based on the calculated flow rate ratio.

As the pressure increases, the flow rate increases in terms of amount and speed, so the pressure and the flow rate are in a proportional relationship. Accordingly, a ratio of the flow rate of the hydraulic oil supplied to the first lift cylinder 210 and the flow rate of the hydraulic oil supplied to the second lift cylinder 220 may be calculated based on the pressures measured by the first pressure sensor 710, the second pressure sensor 720, and the third pressure sensor 730.

As such, in the second embodiment of the present disclosure, the pressure regulating valve 500 is operated under the control of the controller 700 to supply a flow rate at which the second lift cylinder is operable, so that the first lift cylinder 210 and the second lift cylinder 220 may be operated together while controlling operating speeds of the first lift cylinder 210 and the second lift cylinder 220.

With such a configuration, the forklift truck 102 according to the second embodiment of the present disclosure may also effectively suppress the occurrence of impacts that may occur due to operation switching, by operating the plurality of lift cylinders for operating a multi-stage mast assembly together.

In addition, the forklift truck 102 may also suppress unintended speed changes during the lifting operation of the carrier.

As set forth hereinabove, the forklift truck according to one or more embodiments of the present disclosure may operate the plurality of lift cylinders together for operating a multi-stage mast assembly, thereby effectively suppressing occurrence of an impact that may occur upon operation switching between the plurality of lift cylinders.

Although the present disclosure described above has been described with reference to the illustrated drawings, it is apparent for those in the pertinent art that the present disclosure is not limited to the described embodiments and that it may be variously modified and changed without departing from the spirit and scope of the present disclosure.

Therefore, it should be construed that the embodiments described above are illustrative in all respects and should be understood as non-limiting, and the scope of the present disclosure is indicated by the following claims, and the meaning and scope of the claims and any altered or modified form derived from the equivalent concept are included in the scope of the present disclosure.

What is claimed is:

1. A forklift truck in which a carriage moves up and down by a mast assembly in a multi-stage structure including an outer mast, a first inner mast accommodated in the outer mast and moving up and down, and a second inner mast accommodated in the first inner mast and moving up and down, the forklift truck comprising:

a first lift cylinder configured to move the first inner mast up and down;

a second lift cylinder configured to move the second inner mast up and down and having a pressure reception area less than a pressure reception area of the first lift cylinder;

a first lift hydraulic line configured to supply a hydraulic oil to the first lift cylinder;

a second lift hydraulic line connected to the first lift hydraulic line and configured to supply a hydraulic oil to the second lift cylinder; and a pressure regulating valve installed on the first lift hydraulic line and configured to increase a pressure of the hydraulic oil to a pressure capable of driving the second lift cylinder, wherein:

the pressure regulating valve adjusts an opening rate by using a pilot pressure and an elastic member and adjusts a pressure increase amount by adjusting an elastic modulus of the elastic member, and a front-end pressure of the pressure regulating valve, a pressure of the hydraulic oil supplied to the first lift cylinder, and a pressure of the hydraulic oil supplied to the second lift cylinder are received as the pilot pressure, and an opening area is proportionally controlled based on the pilot pressure.

2. The forklift truck of claim 1, further comprising:

a main control valve configured to control supply of the hydraulic oil to the first lift cylinder and the second lift cylinder;

a main hydraulic pump configured to supply the hydraulic oil to the main control valve; and a main lift hydraulic line of which one end is connected to the main control valve and another end is connected to the first lift hydraulic line and the second lift hydraulic line.

3. The forklift truck of claim 1, wherein the pressure supplied to the second lift cylinder acts in the same direction as an elastic force of the elastic member, and the front-end pressure of the pressure regulating valve and the pressure of the hydraulic oil supplied to the first lift cylinder act in a direction opposite to the elastic force of the elastic member.

* * * * *